United States Patent [19]

Akiyama

[11] Patent Number: 4,998,566

[45] Date of Patent: Mar. 12, 1991

[54] LIQUID WARP SPLICING SYSTEM FOR A WARP IN A LOOM

[75] Inventor: Yasuo Akiyama, Kyoto, Japan

[73] Assignee: Murata Kikai Kabushiki Kaisha, Kyoto, Japan

[21] Appl. No.: 328,565

[22] Filed: Mar. 24, 1989

[30] Foreign Application Priority Data

Mar. 30, 1988 [JP] Japan ..... 63-76682
Apr. 13, 1988 [JP] Japan ..... 63-90828
Apr. 14, 1988 [JP] Japan ..... 63-91919

[51] Int. Cl.[5] ..... D03J 1/16; B65H 69/06

[52] U.S. Cl. ..... 139/35; 139/1 R; 57/22; 28/210

[58] Field of Search ..... 57/22; 28/171, 210, 28/211, 209; 242/35.6 R; 139/1 R, 35, 336 R

[56] References Cited

U.S. PATENT DOCUMENTS 4,121,409 10/1978 Uchida et al. ..... 57/22
4,321,736 3/1982 Rohner ..... 28/210
4,428,992 1/1984 Street et al. ..... 57/22
4,571,929 2/1986 Bertrams ..... 57/22
4,573,313 3/1986 Bertrams ..... 57/22
4,608,816 9/1986 Bertrams et al. ..... 57/22
4,817,675 4/1989 Dewaele et al. ..... 139/35
4,852,339 8/1989 Premi ..... 57/22

FOREIGN PATENT DOCUMENTS 0158933 10/1985 European Pat. Off. ..... 139/35

*Primary Examiner*—Andrew M. Falik
*Attorney, Agent, or Firm*—Spensley Horn Jubas & Lubitz

[57] ABSTRACT

A yarn splicing system for splicing a warp in a loom wherein a yarn splicing apparatus is provided with apparatus for searching for a yarn end on the warp beam side of a cut warp. The yarn splicing apparatus may also include a liquid tank for removing size of a sized yarn and a pneumatic yarn splicing device for splicing the yarn end with one end of an additional yarn.

9 Claims, 7 Drawing Sheets

LIQUID WARP SPLICING SYSTEM FOR A WARP IN A LOOM

FIELD OF THE INVENTION

The present invention relates to an automatic yarn splicing system for warp in a loom.

RELATED ART STATEMENT

In a loom used for the weaving step, for example, a multiplicity of warps 1 as shown in FIG. 9 are subjected to shedding motion by a shedding device such as a dobby and Jacquard, and a weft 2 is supplied into the shedding by weft transport means 3 such as a shuttle, a rapier, fluid or the like to weave cloth. That is, the warp 1 of a woven cloth portion drawn out of a warp beam 4 passes through a hole 6 of a held 5 into a reed 7 and is then wound on a woven cloth winding roll 8.

In such a loom S, the warp 1 is sometimes cut at X by a yarn defect contained in the warp or for the other cause. In such a case, a warp-cut is sensed by a warp cut sensor which is called a dropper, and the loom immediately stops and a lamp is lit to let an operator know the unit in question so that the operator may perform piecing.

In this case, normally, a yarn 9 for piecing called an additional yarn 9 is prepared in advance in the neighborhood of the loom. The operator takes out one of the additional yarns 9 by which one end of said additional yarn 9 is tied to a yarn end of the cut warp on the side of warp beam.

The other end of the additional yarn is allowed to be passed through the hole 6 of the held 5, the reed 7 and the like and stopped by a tape on the cloth on the roller 8 side. Operation of the loom is then restarted.

When a warp-cut occurs on a warp of the loom, as described above, even if a warp-cut signal is provided, it is senseless unless said signal is confirmed by an operator. As a result, loom operations may be unavoidably stopped for long periods of time. Further, it is necessary to have an operator prepare a bundle of additional yarns 9 for the piecing operation in every loom. Preparation of additional yarns is cumbersome and it is necessary to release yarns from a package for the same yarns as the warps and cut them into fixed dimensions. This system raises various problems, such as the problem that, depending upon the size of a frame of a loom, it may be difficult to perform piecing by one operator and, thus, a plurality of operators may be required.

OBJECT AND SUMMARY OF THE INVENTION

It is an object of the present invention to provide a yarn splicing device which is capable of joining a warp automatically in a loom.

According to an embodiment of the present invention, there is provided a yarn splicing truck which moves along a row of warps, search means for a cut yarn end and splicing means for splicing an additional yarn held by the truck itself are mounted on the yarn splicing truck, and the yarn splicing truck may be located at a certain position by a yarn-cut signal so that yarn splicing is automatically carried out. The splicing means comprises a pneumatic yarn splicing mechanism and may include a means for removing size of a sized yarn.

While, a yarn splicing device may be so constructed as to be freely carried one by an operator, that is, to be hand-held splicer for a warp. The apparatus for splicing a warp in a loom comprises an additional yarn to be spliced with a warp cut, a pneumatic splicing mechanism, and a supply mechanism for a suction air flow for treatment of yarn in the pneumatic splicing mechanism or a supply mechanism for a compressed air flow, wherein a joint pipe detachably connected to a blower source or a pressurized air supply source on the side of a loom is mounted on the splicing apparatus. This apparatus may be carried by an operator to a predetermined position of a loom.

DETAILED DESCRIPTION OF PREFERRED EMBODIMENTS

A first embodiment of the present invention will be described hereinafter with reference to the drawings.

Figure 1:
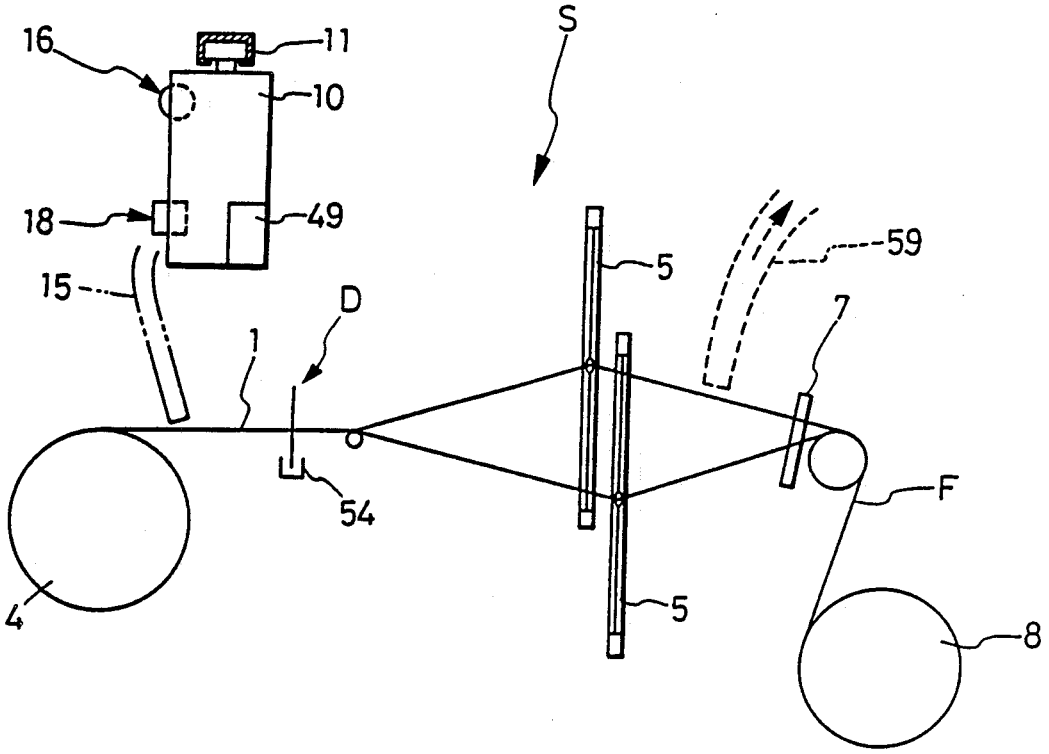
FIG. 1 is a schematic structural side view showing a first embodiment of a system according to the present invention.

In FIG. 1, a yarn splicing truck 10 for splicing a warp cut in a loom S is supported movably along a rail 11 which extends in a direction in which the warps are arranged. In the present embodiment, the truck 10 is provided so as to move above a group of warps between a warp beam 4 and a dropper 12. That is, it is desired that the yarn splicing truck 10 is arranged so that the truck 10 may be positioned as close as possible to a location where warp is cut. For example, in the above-described loom, a warp may be cut in a portion adjacent reed 7. Since there is a high possibility that a weft is urged toward the woven cloth by means of the reed 7, the warp may be cut by contact and friction between the warp and the reed. Accordingly, it is desired that the yarn splicing truck 10 be installed frontwardly of the held 5, namely, on the side of woven cloth, but if a yarn is cut between the held 5 and the beam 4, it is difficult to perform splicing by the truck frontwardly of the held. Accordingly, it is preferable that the yarn splicing truck is positioned between the held 5 and the warp beam 4.

FIG. 1 shows an example in which the truck is arranged at a position closest to the warp beam 4. That is, by the provision of the truck at said position, even if a warp is cut at any position, a yarn end on the side of the warp beam can be searched.

Figure 2:
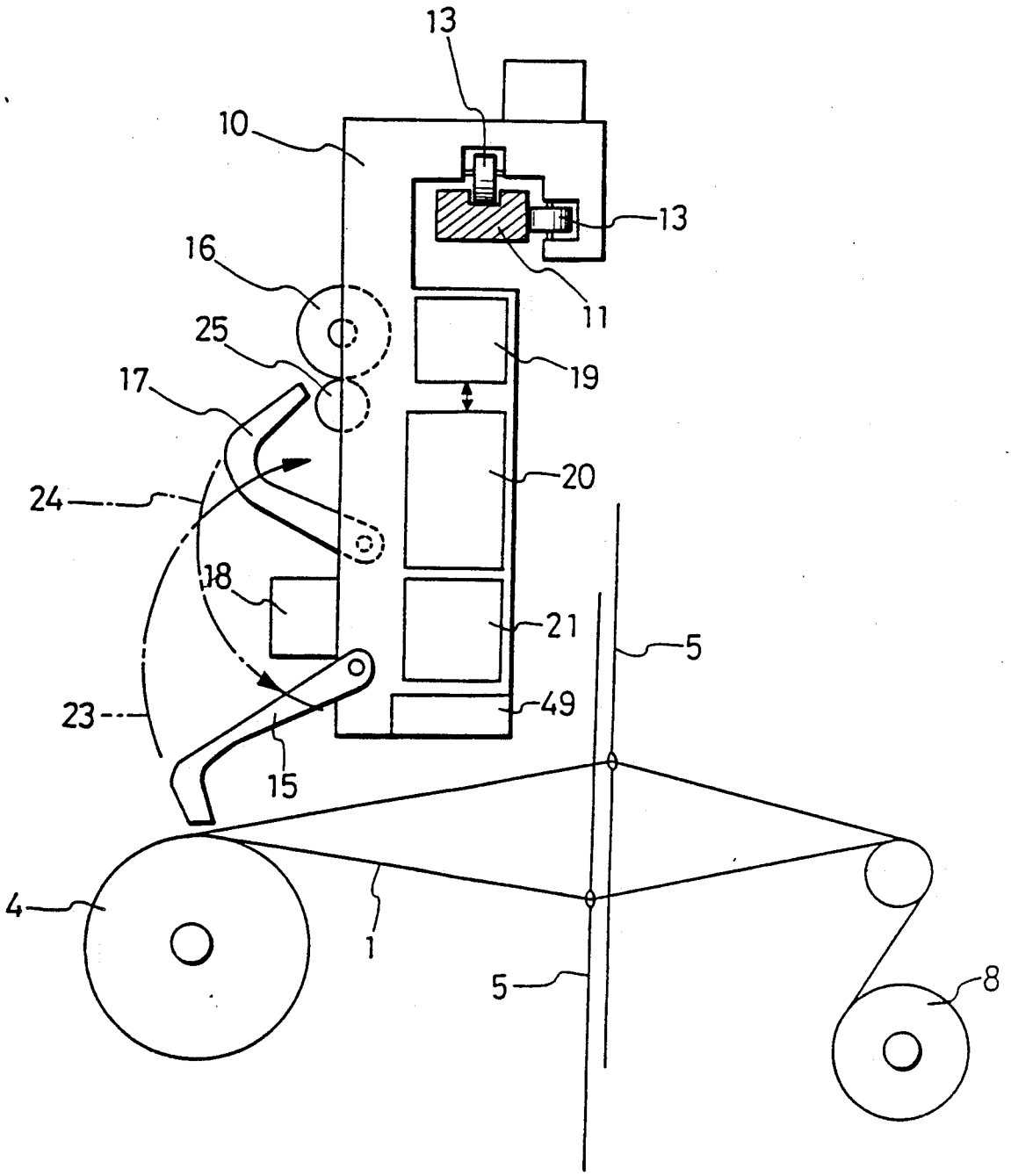
FIG. 2 is a side view showing an embodiment of a yarn splicing truck.
Figure 3:
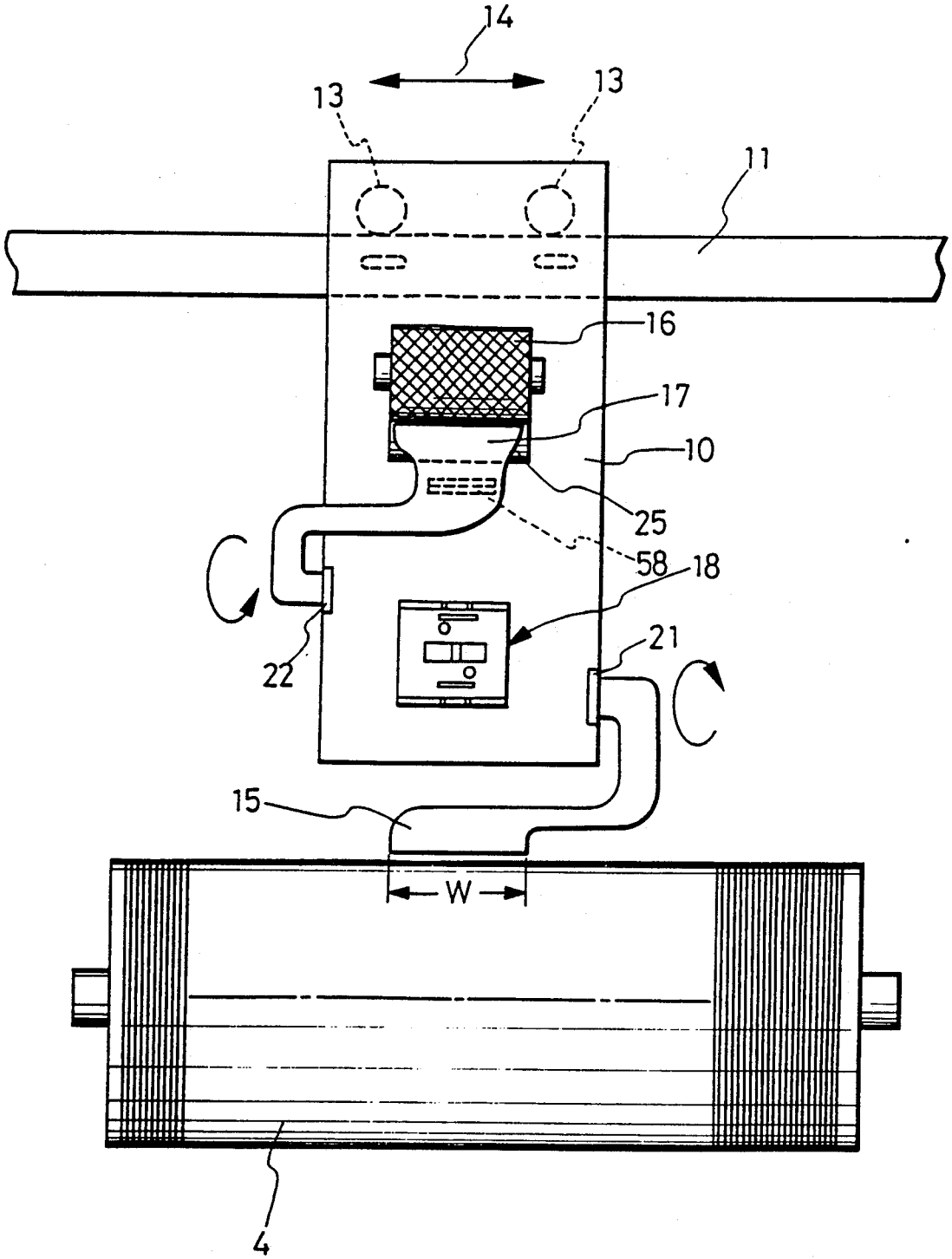
FIG. 3 is a front view of the yarn splicing truck of FIG. 2.

As shown in FIGS. 1 to 3, the yarn splicing truck 10 is suspended and supported on the rail 11 movably in a direction as indicated by arrow 14 through wheels 13 and 13, and principally comprises a first arm 15 for searching an end of a warp on the side of the warp beam 4, a second arm 17 for drawing a yarn from an additional yarn package 16 held by the truck 10 itself, a splicing device 18 for splicing both yarn ends drawn out of the first and second arms, a drive device 19 for driving the aforementioned devices and a control device 20.

The first arm 15 is preferably of a suction arm in which a warp end is searched by a suction force of air, and the second arm 17 is likewise preferably of a suction arm. Further, the splicing device 18 is preferably of a pneumatic splicing device in which splicing can be performed by air force without forming a knot. Accordingly, a blower device 21 for generating a compressed air flow or a suction air flow is mounted on the truck 10, or a suction duct is provided along the rail on which the truck travels so that connection thereof to a pipe within the truck may be conveniently provided.

An opening of the first arm 15 has a width W as shown in FIG. 3 and is shaped so as to extend suction action over a plurality of warps. That is, the opening of the first arm 15 is moved close to the cut warp whereby only the yarn end to be spliced is sucked and can be separated from a group of warps not cut. Also, an opening of the second arm 17 has a width substantially equal to a package width so that a yarn end of the package 16 may be sucked and held. The first and second arms 15 and 17 may be turned as in loci 23 and 24 shown in FIG. 2 about hollow shafts 21 and 22. Reference 25 designates a mere columnar drum which comes into contact with the additional yarn package 16 to rotate the package in a direction of releasing a yarn on the package, the drum being rotated by drive means such as a motor.

Figure 5:
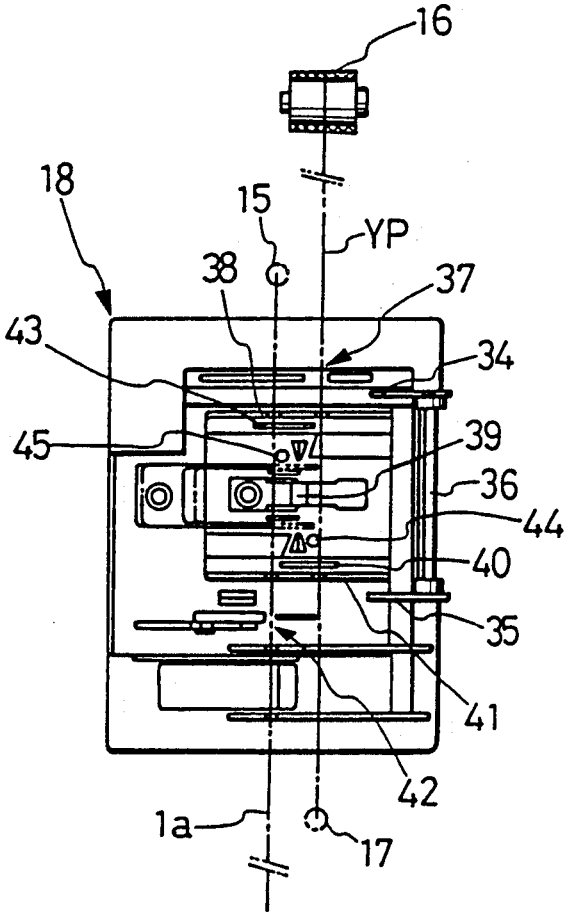
FIG. 5 is a front view showing one example of a splicing device.
Figure 6:
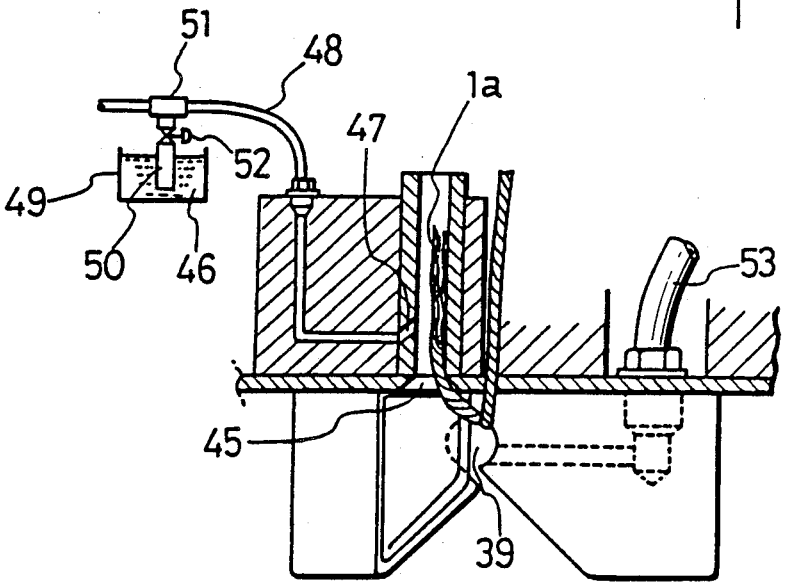
FIG. 6 is a sectional view showing a yarn end untwisting device.

FIGS. 5 and 6 show one example of the splicing device 18 mounted on the truck. In general, warps on the loom are usually sized in order to increase the strength of yarn.

In the above-described splicing device, after yarn ends have been untwisted, the untwisted yarn ends are turned by a turning air flow to effect splicing. However, since the warps are sized, the yarn ends cannot be untwisted in the above-described splicing device. Accordingly, in the splicing device 18, the turning air flow is exerted on the yarn end of the cut sized yarn by the splicing device to perform splicing, after a liquid is applied to the yarn end of the sized yarn to melt size and the yarn end is untwisted.

One embodiment of the above-described splicing device will now be described in detail with reference to the accompanying drawings.

In FIG. 5, reference numeral 18 designates a splicing device provided on the truck 10. When a yarn cut of warp (sized yarn) occurs, the suction arms 15 and 17 suck and hold a yarn 1*a* on the warp side and a yarn YP on the additional package side, respectively, by means of a mechanism not shown to guide them frontwardly of the splicing device 18. On one side of the splicing device 18, yarn handling levers 34 and 35 are turnably provided through a shaft 36, the levers 34 and 35 catching the yarns 1*a* and YP guided frontwardly of the splicing device 18 to further guide them inwardly. Thereby, the yarn YP is moved toward the arm 17 via a clamping device 37, a right groove of a fork guide 38, a splicing hole 39, a yarn cutter 40, and a right groove of a fork guide 41. On the other hand, the yarn 1*a* is moved toward the arm 15 via a clamping device 42, a left groove of the fork guide 41, the splicing hole 39, a yarn cutter 43, and a left groove of the fork guide 38. The clamping devices 37 and 42 clamp the yarns YP and 1*a*, and the yarn cutters 40 and 43 cut the thus clamped yarns YP and 1*a*. The cut yarn ends YP and 1*a* are sucked by nozzle orifices 44 and 45, and liquid 46 which melts size as shown in FIG. 6 is sprayed thereto to untwist them.

The nozzle orifices 44 and 45 are formed with an exhaust hole 47 through which a turning air flow for untwisting the yarn ends YP and 1*a* jets, the exhaust hole 47 being connected to a pressurized air supply source through a pipe 48. On the pipe 48 is provided an injector 51 which sucks the liquid 46 within a liquid tank 49 through a suctionpipe 50, and an opening and closing valve 52 is provided on the suction pipe 50. The liquid may be water or warm water but may also be a solution (which is obtained by adding lactogen to caustic soda, for example) which decomposes size. The pipe 48 is set so that pressurized air is supplied thereto during a period from starting of operation of the yarn cutters 40 and 43 to starting of splicing. The opening and closing valve 52 is controlled so that it is opened at the same time when a supply of pressurized air starts and closed before a supply of pressurized air stops. Pressurized air is supplied for a period of fixed time after the valve 52 has been closed, whereby the yarn ends YP and 1*a* are dried to render untwisting easy.

After the yarn ends YP and 1*a* have been untwisted, the yarn handling levers 34 and 35 further turn to adjust the yarn ends YP and 1*a* to the splicing hole 39. The splicing hole 39 is connected to a pressurized air supply source through a pipe 53 to apply a turning air flow to the yarn ends YP and 1*a* adjusted into the splicing hole 39 to thereby perform splicing.

According to the above-described arrangement, pressurized air as well as liquid 40 are sprayed in the mist form against the yarn ends YP and 1*a* sucked into the nozzle orifices 44 and 45, and therefore, the size adhered to the yarn ends YP and 1*a* is melted to twist the yarn ends YP and 1*a*. The pressurized air is supplied into the nozzle orifices 44 and 45 for a while after spraying of the liquid 46, whereby the yarn ends YP and 1*a* are dried and further untwisted sufficiently. The untwisted yarn ends YP and 1*a* are adjusted to the splicing hole 39, and splicing is conducted by the action of the turning air flow.

In this manner, the liquid is sprayed against the yarn ends of the sized yarns to melt or decompose the size, after which the yarn ends are untwisted, and therefore, the even sized yarns can be easily untwisted. Accordingly, the splicing device can be used to splice the sized yarn. Since the splicing device can be used to splice the sized yarn, it is possible to install a splicing device for splicing warps even on the loom. Since the liquid is sprayed within the nozzle orifices 44 and 45, the liquid is not scattered to stain external portions.

In the case where the size is melted and removed, if a small amount of size is made to be left on the yarn ends, the size is solidified after splicing whereby further strong yarn strength may be obtained.

While in the embodiment, the liquid has been sprayed within the nozzle orifices 44 and 45, it is to be noted that since the liquid is applied prior to untwisting, the liquid may be sprayed when the yarn is cut by the yarn cutters 40 and 43.

Furthermore, while in the above embodiment, the liquid has been sprayed against the yarn ends YP and 1*a*, it is to be noted that the liquid may be applied to the yarn ends YP and 1*a* by dipping the yarn ends in the liquid, and that warm air may be sprayed against the yarn ends YP and 1*a* to dry them. It is noted that drying of yarn ends is not always required.

Next, the operation of the yarn splicing truck will be described.

Figure 4:
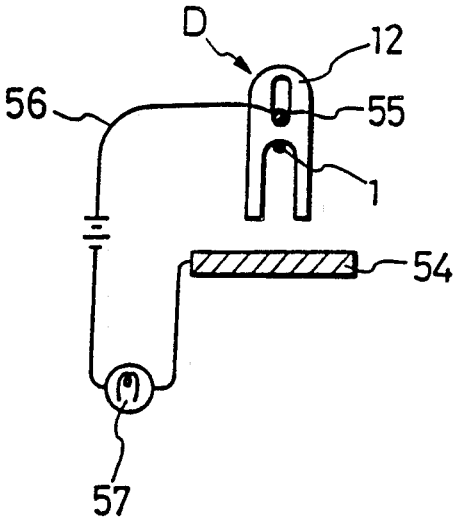
FIG. 4 is a side view showing a detector for detection of a warp cut.
Figure 7:
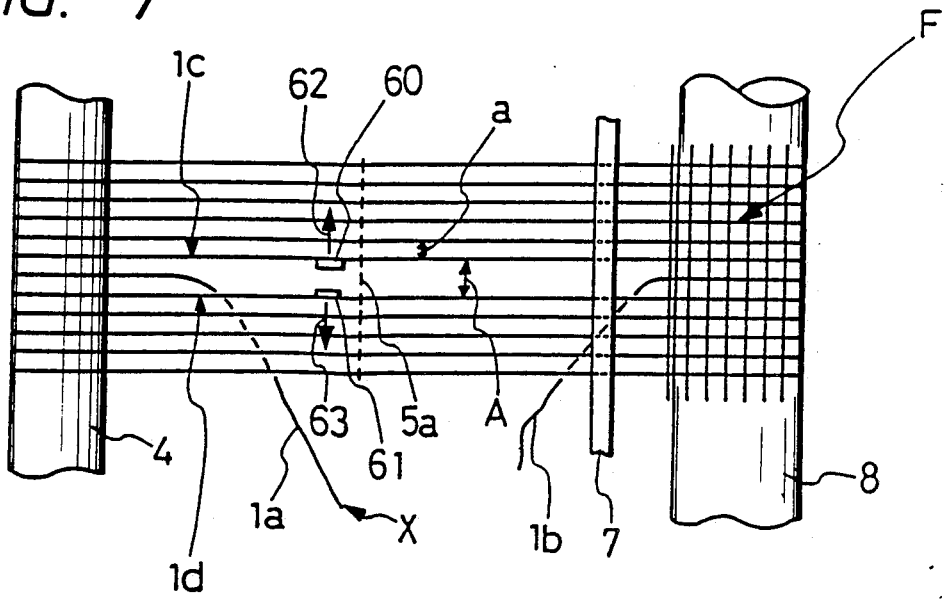
FIG. 7 is a plan view of a portion of a loom showing the state in which warp is cut.

For example, assume that the warp 1*a* was cut at X between the held 5*a* and the warp beam 4 as shown in FIG. 7, the warp-cut detection device D shown in FIGS. 1 and 4 is actuated to detect a warp-cut. That is, a dropper 12 shown in FIGS. 1 and 4 is formed of a conductive material and is supported on a fully stretched warp 1 as shown in FIG. 4 every warp 1 with a clearance formed between it and a lower sensing plate 54. Since when a yarn-cut occurs, tension of the cut yarn is rapidly reduced, the dropper 12 moves down along a metal shaft 55 into contact with the sensing plate 54 whereby the shaft 55, the dropper 12 and the sensing plate 54 are energized by an electric wire 56, and a yarn-cut display member 57, for example, a lamp is lit. Accordingly, if an individual sensing plate 54 is provided for each warp 1 and a signal line is provided for each sensing plate, a position of the cut warp can be detected. Since in the present embodiment, one warp need not be recognized, the sensing plate 54 can serve as a common sensing plate over a plurality of warps. Since the suction opening of the first suction arm 15 for searching a warp is wide in width, if the opening of the suction arm is positioned in the neighborhood of the position of the cut warp, the cut yarn end can be sucked and searched.

The yarn splicing truck 10 stops at a fixed position on the basis of a detection signal of the warp-cut detection device D. Next, the first arm 15 turns to the position shown in FIG. 3, that is, to the portion near a group of warps to suck a yarn end joined to the cut-warp beam 4. That is, if the warp portion 1*a* in the neighborhood of the beam 4 in FIG. 7 is sucked, the yarn end portion 1*a* of which end is free is easily sucked by the suction arm. Even if a cut location is between the held 5*a* and the reed 7, the yarn connected with the beam 4 passes through the held 5*a* and is sucked by the suction arm 15 by the suction force.

The first suction arm turns as indicated by the phantom line in FIG. 2, and a warp between the beam 4 and the suction arm 15 is guided to a fixed position of the splicing device 18.

On the other hand, the second suction arm 17 on the truck 10 turns to the position close to the surface of the additional yarn package 16 as shown in FIGS. 2 and 3 to suck the yarn end on the side of the package 16, and the additional yarn between the package 16 and the second suction arm 17 is guided to the splicing device 18 by the rotation of the drum 25 in the direction of releasing the package and the turning of the second suction arm 17 in the direction of arrow 24 in FIG. 2.

Subsequently, when the splicing is carried out by the operation of the splicing device 18, the additional yarn package 16 is rotated as desired in the direction of releasing the yarn so as to have the length of yarn enough to thread the held and reed and lock the yarn end on the woven cloth, and the yarn is pulled out, after which the yarn is cut by the cutter 58 shown in FIG. 3. Accordingly, a sufficient length of an additional yarn joined to the warp beam 4 is now prepared.

The yarn end portion 1*b* on the side of the cloth roll 8 resulting from the warp cut as shown in FIG. 7 is sucked by the suction arm 59 in FIG. 1 and cut at the position in the vicinity of the cloth. Preferably, an extra yarn is sucked and removed. It is possible to arrange the suction arm 59 so as to be extended from the yarn splicing truck 10.

Next, the threading operation for a spliced additional yarn joined to the warp beam is carried out. It is desired at this time that all the helds are levelled to the same height.

Figure 8:
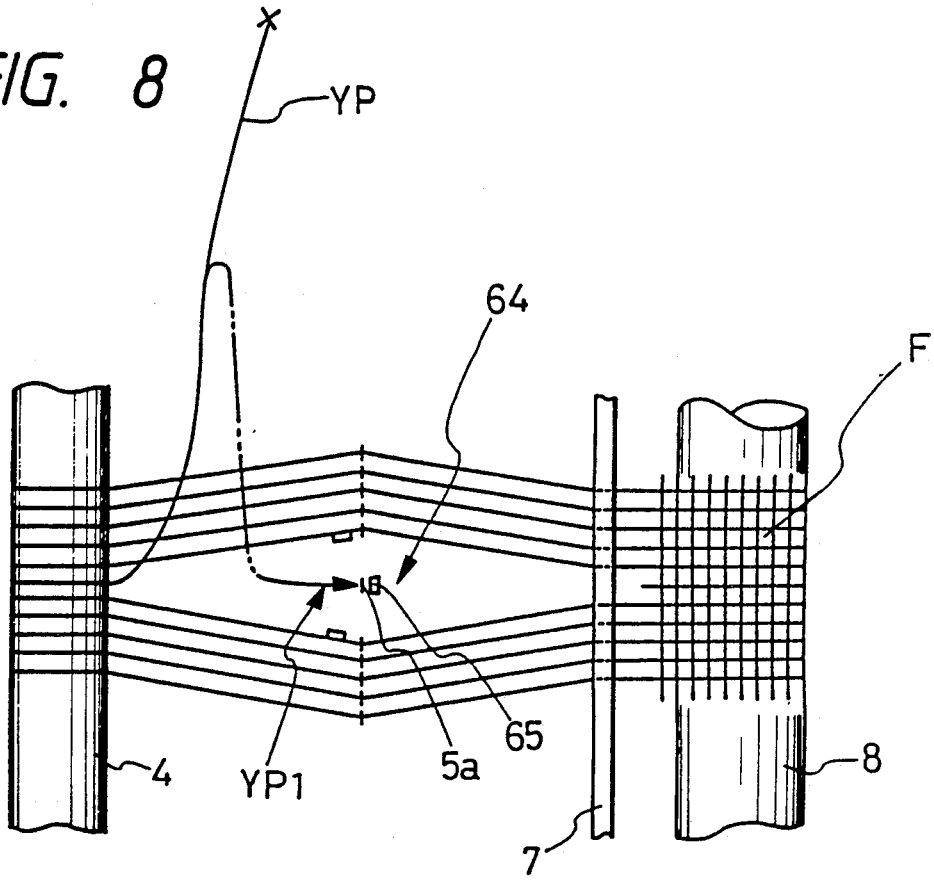
FIG. 8 is a schematic plan view of a portion of a loom showing a threading method for a warp.

The aforesaid threading can be manually carried out by use of a known threading device, but can also be carried out by providing an automatic threading device on the yarn splicing truck. For example, a clearance A between warps in a portion where a warp is cut is larger than a clearance (a) between the other warps, as shown in FIGS. 7 and 8, the this widened clearance is mechanically or optically detected, and guides 60 and 61 are brought into contact, from the truck side, with warps 1*c* and 1*d* on both sides of a yarn running area of the cut warp 1*a* to spread them in the direction of arrows 62 and 63 in FIG. 7, whereby large spaces 64 are formed on both sides of the held 5*a* through which the additional yarn YP passes as shown in FIG. 8. This space is utilized to position and stand-by, from the truck side, a yarn end holding member 65 on the position on the side of cloth roll 8 of the held, and an arm member holding the end YP1 of the additional yarn YP on the side of the warp beam 4 of the held 5*a*. The yarn is threaded through the hole of the held 5*a* to deliver the foremost end of the yarn end to the stand-by yarn holding member 65, thus completing threading of the held 5*a*.

Prior to the held, threading of the dropper and threading to the held are carried out and thereafter threading of the reed 7 is similarly carried out. Then, the foremost end of the yarn end of the additional yarn can be guided onto the cloth roll 8.

Next, the foremost end of the yarn end of the additional yarn having been threaded is once locked on the cloth F, that is, the tape is affixed or the yarn end holding member (65 in FIG. 8) is located and stopped on the cloth, and if the loom is again operated, even if the foremost end of the additional yarn is released after several wefts have been woven, the additional yarn is woven into the cloth without failure to be fallen.

In the above-described yarn splicing truck 10, a system may be employed in which one truck is provided for one loom, or one a yarn splicing truck is provided on a plurality of looms so that the truck is made to travel to the loom by a yarn-cut signal so as to effect the aforementioned splicing.

As described above, according to the first embodiment of the present invention, the warp splicing in the loom can be automatically carried out by the movable splicing truck, and the cumbersome yarn joining operation by the operator can be avoided. The trouble required to prepare a bundle of additional yarns on the loom and the space can be eliminated, and the working efficiency in the loom mill can be further enhanced.

A second embodiment of a yarn splicing apparatus will be described hereinafter. The yarn splicing apparatus is so constructed as to be freely carried one by an operator, that is, to be a hand-held splicer for a warp.

Figure 11:
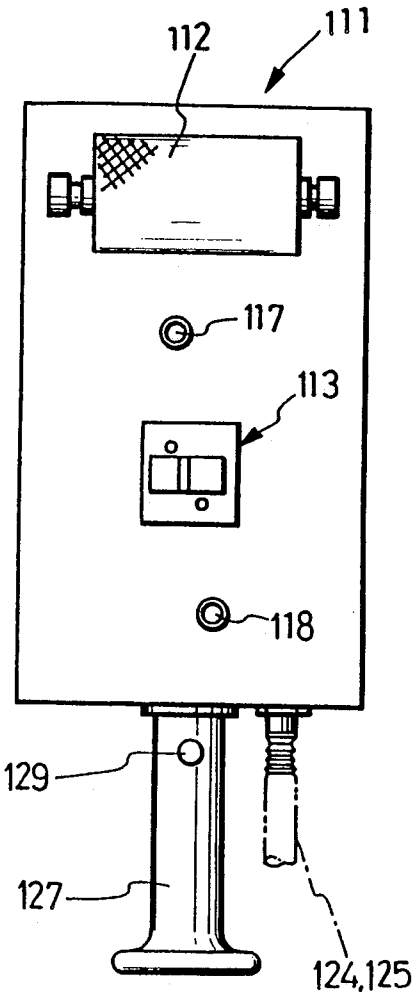
FIG. 11 is a front view of the device shown in FIG. 10.
Figure 10:
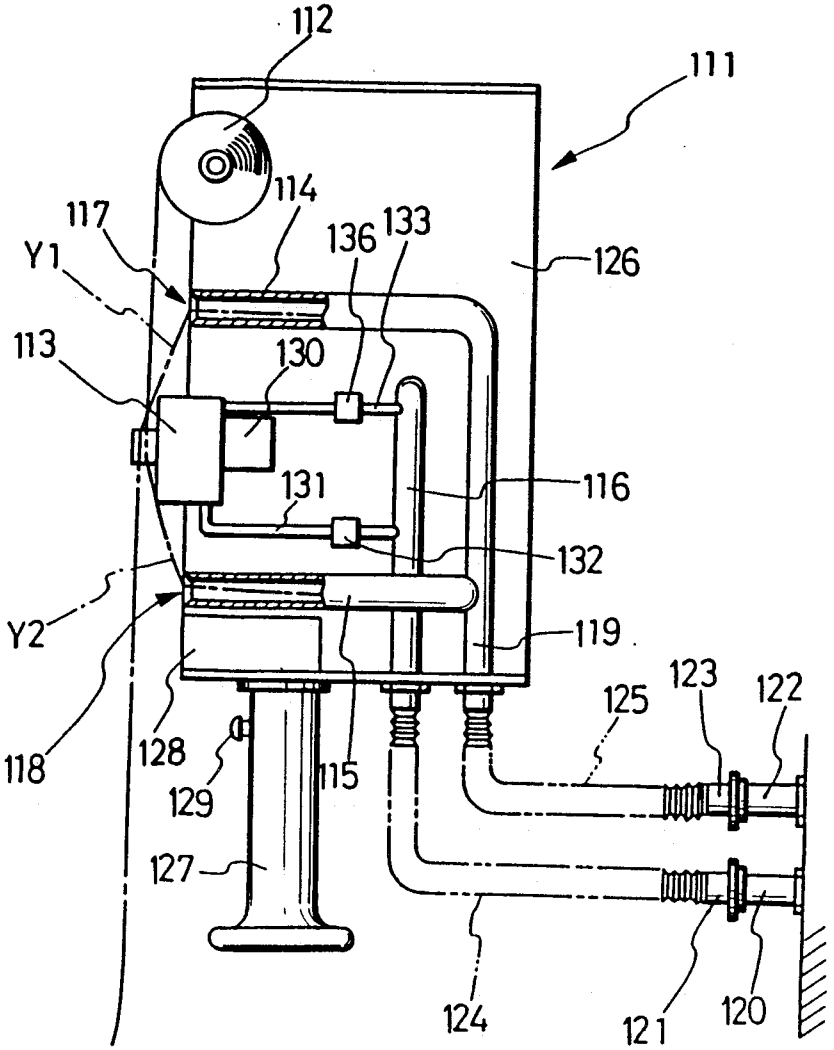
FIG. 10 is a side view partially in section showing a second embodiment according to the present invention.

FIGS. 10 and 11 show a schematic structure of yarn splicing apparatus 111. That is, the splicing apparatus 111 comprises an additional yarn package 112 on which yarns to be spliced with a warp cut are wound in a package-like fashion, a pneumatic splicing unit 113 for splicing a warp Y1 and said additional yarn Y2, yarn-end holding mechanisms 114 and 115 for holding said yarn ends Y1 and Y2, a compression supply pipe 116 for supplying compressed air to the pneumatic splicing unit and so on. In the above-described embodiment, as a yarn end holding mechanism, a pair of suction openings 117 and 118 are provided on both sides of the splicing unit, and accordingly, in this case, a suction pipe 119 is mounted to exert a suction air flow on the suction openings 117 and 118. A one-touch joint 121 to be connected to a pipe 120 in communication with a pressurized air supply source on the side of a loom is mounted on the end of a flexible pipe 124 connected to the pressurized air supply pipe 116. Similarly, a one-touch joint 123 to be connected to a pipe 122 in communication with a blower source on the ground is mounted on the end of a flexible pipe 125 connected to the suction pipe 119.

In FIG. 10, reference numeral 130 designates a driving mechanism for a splicing apparatus, and 131 a small-diameter pipe for supplying pressurized air to a splicing hole later described, and on and off timing is taken by an electromagnetic valve 132. Reference numeral 133 designates a small-diameter pipe for supplying pressurized air to untwisting nozzles, and a valve 136 is provided in the midst thereof by which water or liquid is contained in pressurized air.

The splicing apparatus 111 is mounted on a body frame 126, to which is secured an operator's grip rod 127 to render portable. Reference numeral 128 designates a control device for controlling the drive of the splicing apparatus, and 129 a switch for actuating the splicing apparatus.

It is a matter of design that various motion members within the splicing unit 113 are operated by an electric motor or by a fluid cylinder. In the case where the electric motor is used as a driving source, a small battery need be installed, whereas in the case of the fluid cylinder used as a driving source, pressurized air can be branched from the pressurized air supply pipe 116 to easily obtain the driving. The splicing unit 113 may be so constructed as the splicing device 18 which has been aforementioned.

The operation of the splicing apparatus 111 will be now illustrated.

When a yarn-cut display lamp on the loom is lit on the basis of a detection signal from the warp-cut detection device D shown in FIG. 4, the operator arrives at the position of the loom to start splicing work.

First, as shown in FIG. 10, the operator connects the pressurized air pipe 124 extended from the body frame of the piecing apparatus and the suction pipe 125 with the pipes 120 and 122 provided on the loom or on the ground.

Figure 9:
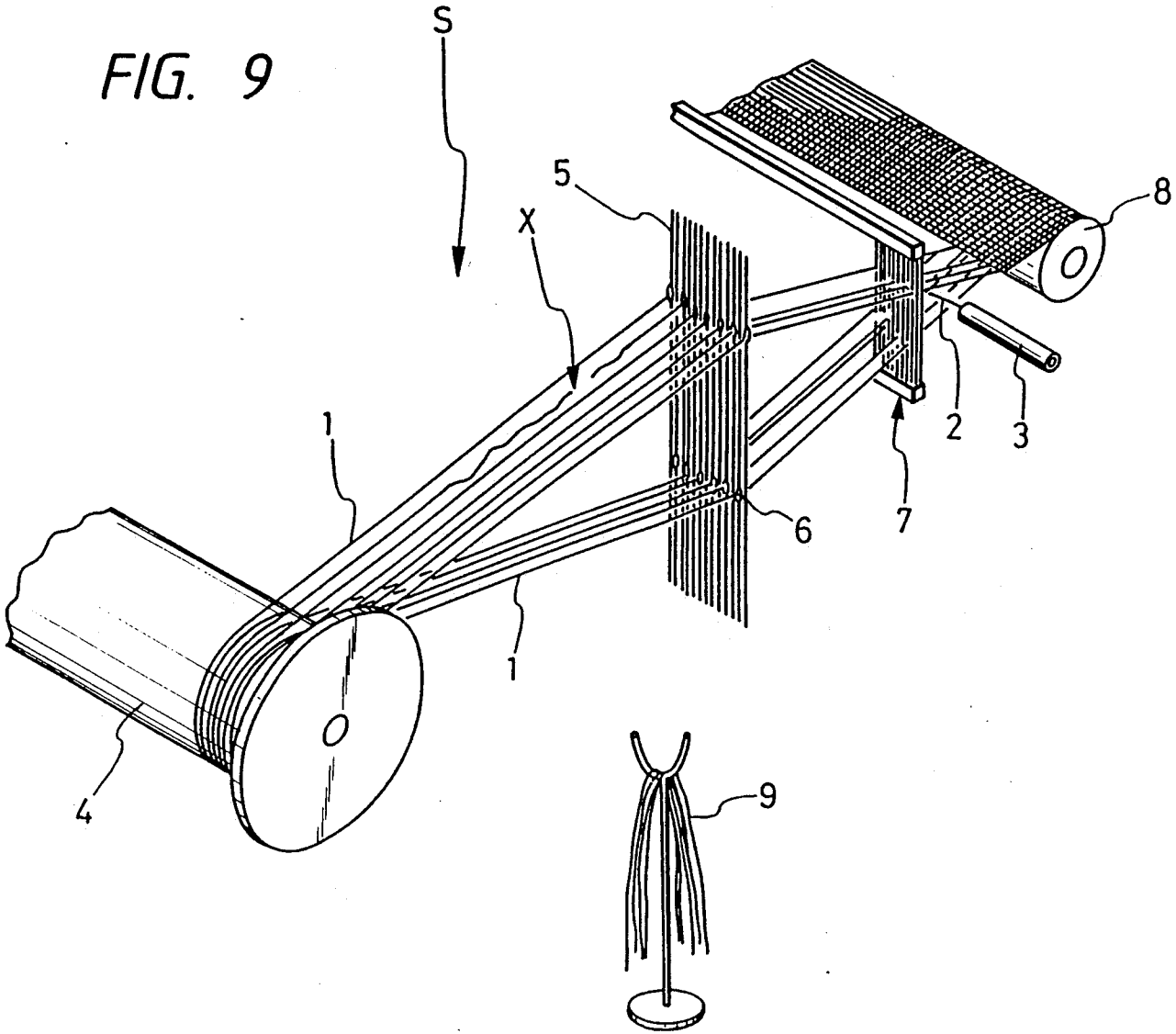
FIG. 9 is an inclined view of a portion of a loom showing the state in which warp is cut.

Then, the operator looks for the yarn end Y1 joined to the warp beam 4 (FIG. 9) of the cut warp and guides the yarn end Y1 to the first suction opening 117 in FIG. 10 so that the yarn end is sucked and held. Further, the yarn end Y2 drawn out of the additional yarn package 112 is guided to the second suction opening 118 to complete preparation of splicing. At this time, the yarns Y1 and Y2 are in the state as shown in FIG. 5, and subsequently, when the splicing start switch button 129 (FIG. 10) is depressed, the above-described yarn-end operation is carried out. When splicing is carried out, the additional yarn package 112 is rotated in the yarn releasing direction so that the yarn is threaded through the held and reed so as to have the yarn length enough to fix the yarn end on the woven cloth, and the yarn is pulled out, after which the yarn is cut by means of a cutter provided on the frame or held by the operator. Accordingly, an additional yarn Y3 joined to the warp beam 4 is to be prepared with a sufficient length.

Then, threading operation of a spliced additional yarn joined to the warp beam is carried out by the operator. It is desired at this time that all the held are levelled to the same height.

Prior to the above-described held, threading of a dropper and threading of the reed after the threading of held are similarly carried out, then the foremost end of the yarn end of the additional yarn can be guided onto the cloth roll.

Subsequently, in the state wherein the foremost end of the yarn end of the additional yarn having been threaded is once locked on the cloth, that is, in the state wherein it is affixed by a tape or the yarn-end holding member is positioned and stopped on the cloth, if operation of the loom is re-started, an additional yarn is not woven into the cloth and fallen even if the foremost end of the additional yarn is unlocked after several wefts have been inserted.

As described above, in this second embodiment of the present invention, a yarn splicing apparatus in a loom is formed from a pneumatic splicing apparatus, and a pipe for supplying a fluid flow which causes said splicing apparatus to be operated is detachably mounted, whereby the operator can freely carry the apparatus. Splicing with a seam equal to a coarseness of warp can be carried out without forming a lumpish knot as in prior art. The apparatus can be applied to the existing loom, contributing the manufacture of woven fabrics having a good quality.

What is claimed is:

1. A yarn splicing system operable with a loom having a row of warps, the system comprising:

search means for finding a yarn end on the warp beam side of a severed warp; and splicing means for splicing the found yarn end with one end of an additional yarn;

wherein said splicing means comprises an additional yarn package for splicing, a liquid tank for removing size of a sized yarn, and a splicing device for splicing said additional yarn with a cut warp.

2. A yarn splicing system as claimed in claim 1, further comprising:

a movable yarn splicing truck, movable along the row of warps of the loom; and drive means for moving the truck;

wherein the search means and the splicing means are supported by the truck.

3. A warp splicing truck movable along a row of warps of a loom and operable with means for moving the truck along the row of warps, the warps comprising sized yarns, said warp splicing truck comprising: an additional yarn package having additional yarn for splicing, a liquid tank for removing size of sized yarn, and a splicing device for splicing said additional yarn with a cut warp end so that the end of the cut sized yarn is untwisted after a liquid is applied to the yarn end of the sized yarn to melt size, the splicing device having means for applying a turning air flow to the untwisted yarn end such that the untwisted yarn end is turned by the turning air flow to effect splicing.

4. The warp splicing truck as claimed in claim 3, wherein said yarn splicing truck further includes a first suction arm for searching for an end of a warp and a second arm for drawing a yarn from the additional yarn package, the first suction arm and the second arm having means for introducing the warp end and the yarn into the splicing device, respectively.

5. The warp splicing truck as claimed in claim 3, wherein said splicing device comprises a splicing hole, a pair of clamping devices, and a pair of yarn cutters, and wherein the mean for applying a turning air flow comprises a pair of nozzle orifices for untwisting a yarn end of the additional yarn and of the cut sized yarn, respectively, said nozzle orifices being located on both sides of the splicing hole, respectively, and yarn handling levers turnably provided through a shaft on one side of the splicing hole, at least one of said nozzle orifices being formed with an exhaust hole through which the turning air flow jets and which is connected with the liquid tank for removing size.

6. The warp splicing truck as claimed in claim 5, wherein an injector which sucks the liquid in the liquid tank through a suction pipe and which sprays the liquid from the exhaust hole is provided on a pipe which connects the exhaust hole with a pressurized air supply source, an opening and closing valve being provided on the suction pipe so that the cut yarn end is sucked into the nozzle orifice and pressurized air as well as liquid are sprayed against the yarn end to melt the size.

7. In a warp splicing apparatus for splicing a warp in a loom, a warp splicing device comprising an additional yarn to be spliced with a severed warp end, a pneumatic splicing mechanism, and at least one of a supply mechanism for a suction air flow for treatment of yarn of said pneumatic splicing mechanism and a supply mechanism for a compressed air flow, characterized in that a joint pipe is detachably connected to a pressurized air supply source and is supported by the warp splicing device, wherein said pneumatic splicing mechanism includes a liquid tank for removing size of a sized yarn so that a yarn end of a cut sized yarn is spliced after liquid is applied to the yarn end to melt the size.

8. An apparatus as claimed in claim 7, wherein the pressurized air supply source comprises a blower.

9. A yarn splicing device for splicing an end of a severed warp with an end of an additional yarn, the yarn splicing device being operable with a loom having a plurality of warps, the yarn splicing device comprising:

liquid applying means for applying a liquid to at least one of the end of the severed warp and the end of the additional yarn; and splicing means for splicing the end of the severed warp with the end of the additional yarn;

a movable truck movable adjacent the plurality of warps; and drive means for driving the truck;

wherein the liquid applying means and the splicing means are supported by the movable truck and are movable adjacent the plurality of warps with the movable truck.

* * * * *